US005353815A

United States Patent [19]

Gamberini et al.

[11] Patent Number: 5,353,815

[45] Date of Patent: Oct. 11, 1994

[54] CIGARETTE PACKAGING MACHINE

[75] Inventors: Antonio Gamberini, Bologna; Marco Brizzi, Zola Predosa, both of Italy

[73] Assignee: G. D. Societa Per Azioni, Bologna, Italy

[21] Appl. No.: 251,398

[22] Filed: Sep. 30, 1988

[30] Foreign Application Priority Data

Oct. 2, 1987 [IT] Italy ..... 3627 A/87

[51] Int. Cl.[5] ..... A24C 5/35

[52] U.S. Cl. ..... 131/283; 53/234

[58] Field of Search ..... 131/283, 282; 53/149, 53/234, 252

[56] References Cited

U.S. PATENT DOCUMENTS 4,903,713 2/1990 Molins ..... 131/283

*Primary Examiner*—V. Millin

*Attorney, Agent, or Firm*—Cushman, Darby & Cushman

[57] ABSTRACT

The packaging machine makes use of a first wheel to supply single groups of cigarettes, in succession, to a work station, where a corrugated paper distance piece is positioned by a feed device on each group, in direct contact with the face uppermost. A second wheel carries the groups of cigarettes away from the work station, together with their distance pieces. The feed device includes a positive drive assembly that feeds a continuous strip of stiff paper toward the work station and corrugates it in the process, a set of blades which cut the corrugated strip into discrete pieces, and an actuator serving to position each of the cut pieces on a corresponding group of cigarettes.

8 Claims, 3 Drawing Sheets

1
2
3
4
5
6
7
9
10
11
12
13
16
17
18
19
23
27
28
29
31
41
II
II

CIGARETTE PACKAGING MACHINE

BACKGROUND OF THE INVENTION

The invention relates to a cigarette packaging machine.

Conventional machines used to package cigarettes in the types of wrappers most widely marketed are designed, in the majority of instances, to produce an elongated parallelepiped pack containing a given number of cigarettes (usually twenty) some 0.30" in diameter. While the length of such packs may vary, often considerably, their width and depth generally will not depart materially from sets of dimensions regarded by most manufacturers as being standard, and, accordingly, the usual packaging operations of ordering the cigarettes into groups and enveloping them in their wrappings can be effected by machine units which, with a minimum of modification, are able to handle almost any kind of regular package.

In the event, however, that the cigarettes to be packaged exhibit a diameter substantially dissimilar to that mentioned, and are destined to occupy a pack that differs notably from one of regular size, the machine units in question can no longer be adapted by effecting simple modifications; instead, total replacement becomes necessary. Such will be the case for example, when it is sought to package super slim cigarettes (approx 0.15" in diameter) in the same quantity and arrangement as conventionally adopted for regular cigarettes; in fact, the manufacture of super slims involves a marked reduction in the depth of the finished pack, with the result that the pack can no longer be handled by a conventional wrapping unit, or at least, extensive modification will be required to render the unit suitable.

Accordingly, the object of the present invention is to provide a cigarette packaging machine which, whilst in receipt of groups of cigarettes that may exhibit overall dimensions considerably reduced from those of a group of cigarettes of regular diameter (0.30" approx), is nonetheless able to turn them out in packs of substantially conventional size that can be handled by standard wrapping machines without any prior modification or adaptation being necessary.

SUMMARY OF THE INVENTION

In the cigarette packaging machine disclosed, groups of cigarettes are indexed by a first conveyor toward a combined work and transfer station, where a feed device positions a distance piece of corrugated paper in contact with one face (front or back) of each group of cigarettes received; a second conveyor then carries the group away from the work station together with its distance piece.

The feed device comprises infeed means serving to advance a continuous strip of paper toward the work station, corrugating means that provide the continuous strip with a uniformly undulated profile, cutting means by which the continuous corrugated strip is severed into discrete distance pieces, and means by which the distance pieces are transferred to the work station.

Thus, the expedient suggested by the invention is one of increasing the depth of a group of slim cigarettes by adding a distance piece fashioned from corrugated paper, in such a way as to accommodate the dimensional deficit that occurs when passing from regular cigarettes to slims.

Accordingly, in the operating steps that follow, conventional wrapping techniques can be utilized in handling the group of cigarettes, together with its corrugated distance piece, and the dimensions of the pack produced will be substantially those of a pack of regular cigarettes.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
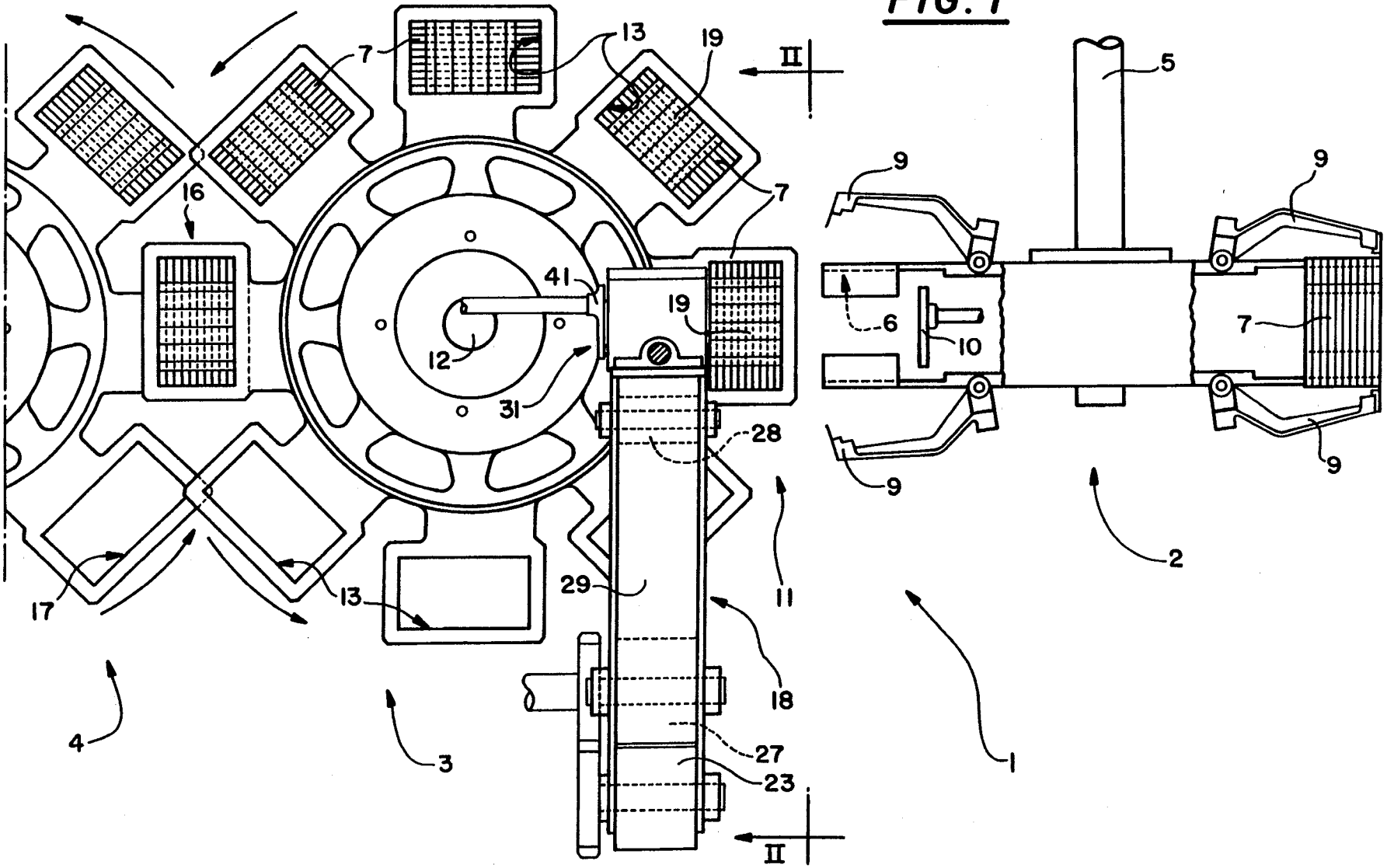
FIG. 1 is a schematic, viewed in plan, showing part of a cigarette packaging machine according to the invention.

In FIG. 1 of the drawings, 1 denotes a cigarette packaging machine, considered in its entirety (part of the machine only is illustrated), which comprises conveyor means comprising a cascade of three wrapping wheels 2, 3 and 4.

The first wheel 2 indexes about a horizontal axis, supported and driven in rotation by a relative drive shaft 5, and is provided with a plurality of peripheral radial pockets 6 (two only are visible in FIG. 1), spaced apart at equal distance and serving to accommodate groups 7 of cigarettes formed at a station further back up the line (not illustrated); in the case in point, the single group 7 is made up of in two stacked layers of ten cigarettes each. Each group thus includes two opposite major faces (a top and a bottom), two narrower sides (a left and a right), and two ends (a front and a rear). Entering the pockets 6 in regular succession and occupying them during the passage from the entry side of the wheel 2 over to the point where transfer is effected to the second wheel 3, the groups 7 of cigarettes are held in position and enveloped in conventional foil wrappers 8 (visible in FIG. 3) with the aid of pincers 9, mounted on the wheel 2 and flanking each pocket 6, that are drawn together and spread apart by conventional actuator means (not illustrated).

In a single movement and in a conventional manner (not illustrated), each foil-enveloped group 7 of cigarettes is ejected from the relative pocket 6 of the first wheel by a push rod 10 and delivered to the second wheel at a work station denoted 11, which coincides with the aforementioned point of transfer.

The second wheel 3 indexes about a vertical axis, supported and driven in rotation by an upright shaft 12, and affords eight peripheral pockets 13 spaced apart at equal distance, each one of which accommodates a group 7 of cigarettes enveloped in its foil wrapper 8. When at standstill, the wheel 3 stands with one pocket 13 occupying the work and transfer station 11, lying alongside the pocket 6 of the first wheel 2 currently in alignment with the ejector rod 10; thus, the rod 10 ejects the groups 7 from the pockets 6 one by one and positions them above the waiting pocket 13 of the second wheel 3. More exactly, each group is taken up by conventional transfer means, illustrated in FIG. 3, that include an elevator assembly comprising a platform 14 and a plate 15, located opposite one another and capable of synchronized vertical movement generated by drive means of conventional embodiment (not illustrated); thus, it is the elevator which effectively positions the cigarettes in the pocket 13 beneath.

The third wheel 4 also indexes about a vertical axis and is disposed adjacent to the second wheel 3, coinciding therewith at a runout station denoted 16, where conventional transfer means (not illustrated) take the single groups 7 from the pockets 13 of the second wheel and place them in peripheral pockets 17 afforded by the third. In effect, the third wheel 4 forms part of a further machine unit, details of which are not illustrated, by which the groups 7 of cigarettes transferred from the second wheel 3 are enveloped in their outer wrappings.

Figure 2:
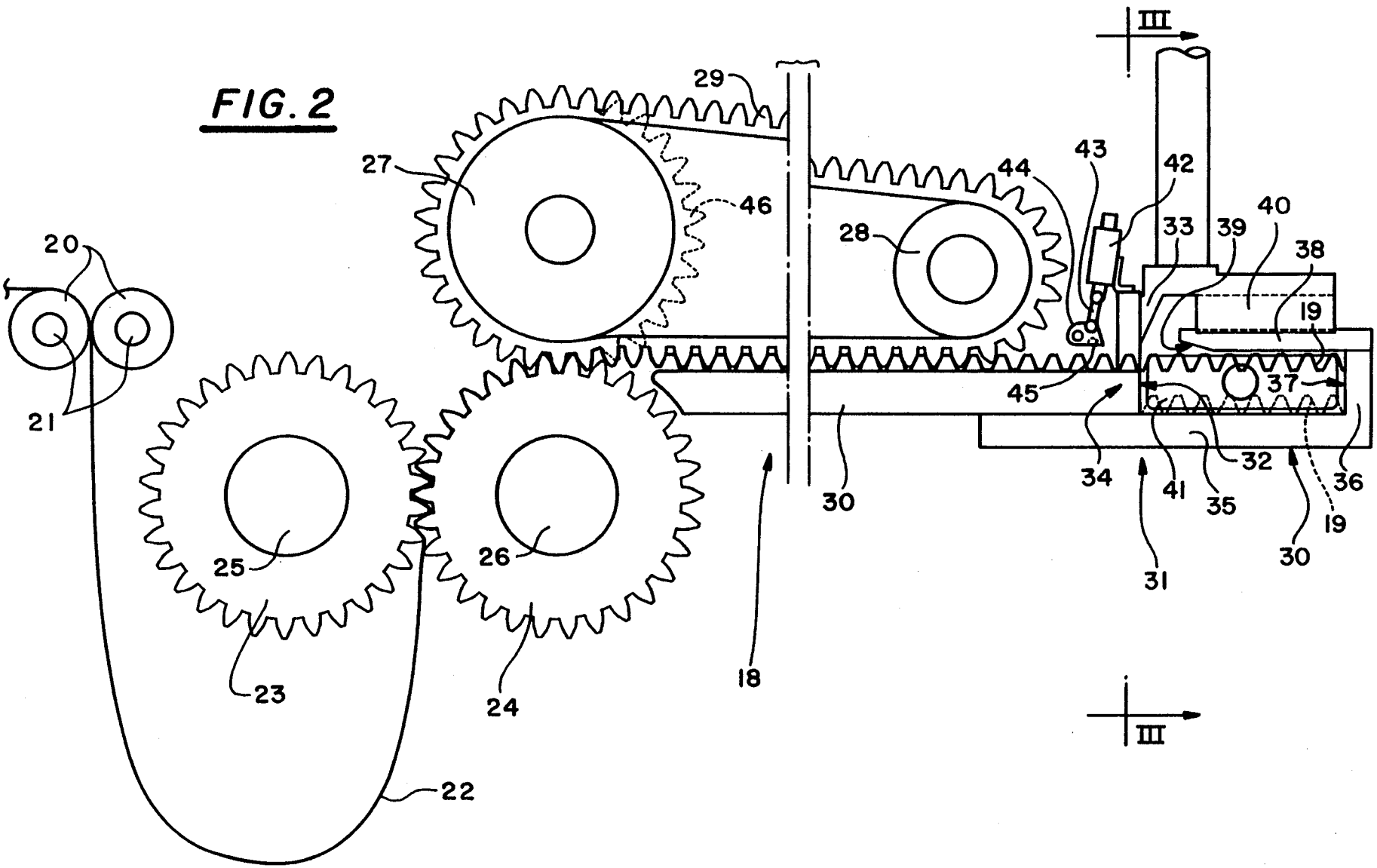
FIG. 2 is the elevation of II—II in FIG. 1, which shows a detail of the packaging machine.
Figure 3:
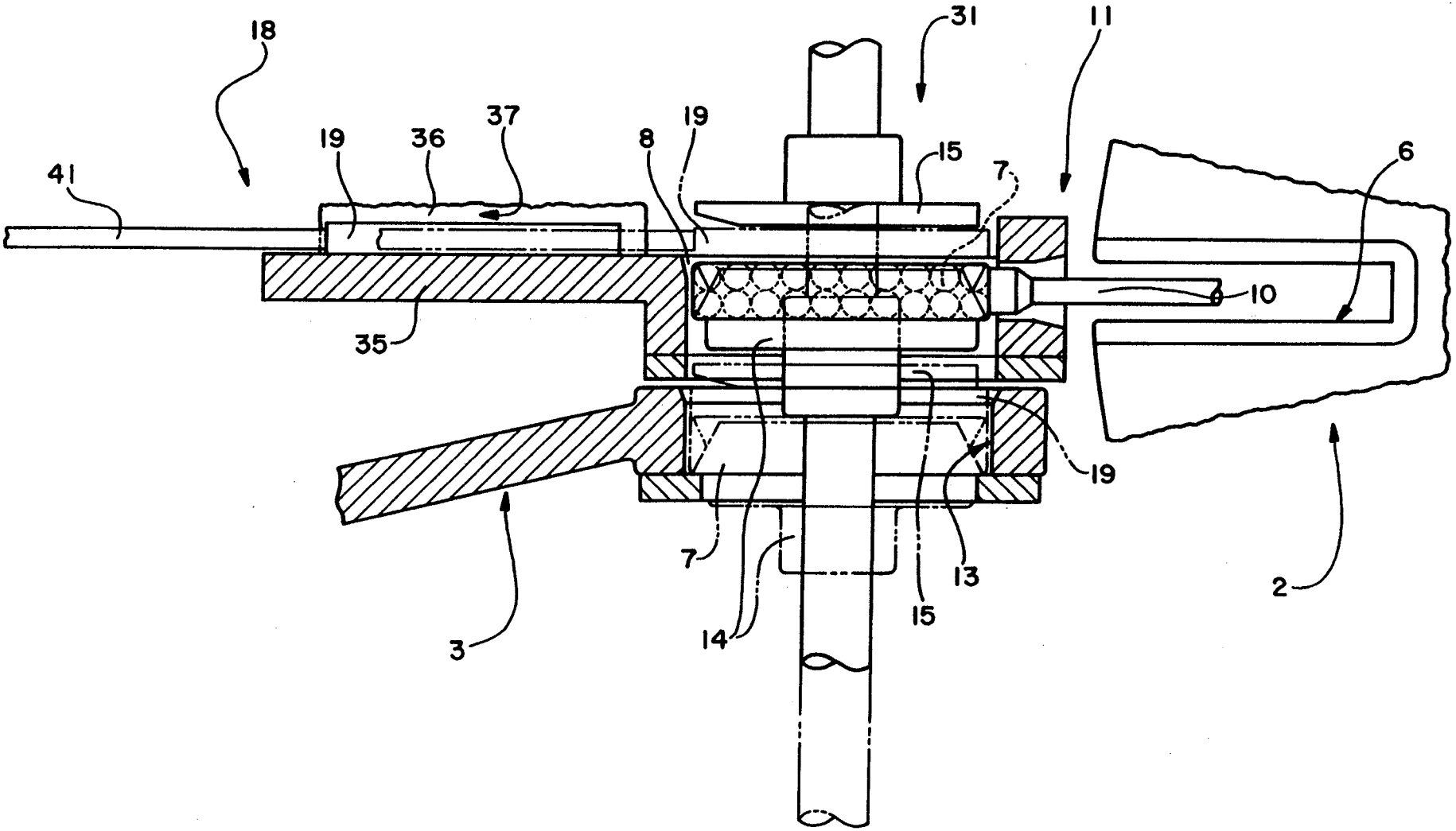
FIG. 3 is the elevation of III—III in FIG. 2, which shows a further detail of the packaging machine.

FIG. 2 shows in elevation, certain details of the cigarette packaging machine from the vantage point of looking in the direction of arrows II—II in FIG. 1, and FIG. 3 shows in fragmentary elevation, certain details of the cigarette packaging machine from the vantage point of looking in the direction of the arrows III—III in FIG. 22.

The numeral 18 denotes a feed device (illustrated in greater detail in FIGS. 2 and 3) installed with its feed end in close proximity to the work station 11, which serves to add a distance piece 19, fashioned from corrugated paper, to each group 7 of cigarettes.

The feed device 18 comprises a pair of pinch rollers 20, carried by horizontal counter-rotating shafts 21, that serve to uncoil a continuous strip 22 of stiff paper from a bulk roll (not illustrated) and direct it between a pair of gears 23 and 24 located respectively on the left and right of the strip 22, as viewed in FIG. 2; the gears 23 and 24 turn on respective horizontal and counter-rotating shafts 25 and 26 which are driven intermittently by means not illustrated in the drawings.

The numeral 27 denotes a first pulley, positioned above the right hand gear 24 with its axis lying parallel to those of the two horizontal shafts 25 and 26, which combines with a second horizontally disposed pulley 28 in supporting a timing belt loop 29; one section of the first pulley 27 will be seen to mesh with the topmost teeth of the right hand gear 24. The bottom branch of the timing belt loop 29 rides flat over a fixed horizontal table 30 extending from the right hand gear 24 toward an infeed position, denoted 31, which is located above the second wheel 3 between the work and transfer station 11 and the shaft 12 (see also FIG. 1).

The numeral 32 denotes the butt end of the fixed horizontal table 30 lying just beyond the second pulley 28, the top edge of which is sharpened and combines with a vertically mobile blade 33 (operated by drive means that are not illustrated) to provide cutting means, denoted 34 in their entirety, by which the strip 22 of stiff corrugated paper is severed into discrete distance pieces 19.

The numeral 30' denotes an L-shaped appendage, fastened to the underside of the table 30 at the infeed end 31, which comprises a flat section 35 extending forward horizontally in line with the table, and an upright member 36 extending vertically from the end of the flat section 35, which combine with the butt end 32 to form a substantially C-shaped chamber 37 disposed with its one open side facing upward. The top of the upright member 36 supports a horizontal plate 38, extending part of the way across the open top of the chamber 37, which is beveled along the lower edge 39 directed toward the horizontal table 30.

The numeral 40 denotes a substantially C-shaped shoe rigidly associated with the moving blade 33 and disposed with its hollow side down, facing the chamber 37. The two vertical members of the shoe 40 lie at right angles to the axes of the two gear shafts 25 and 26 and project downward on either side of the plate 38 to terminate with their bottom edges at a height marginally above the cutting edge of the blade 33.

Observing FIGS. 2 and 3, it will be discerned that the chamber 37 is able to accommodate transfer means, denoted 41, including in a horizontal push rod 41 reciprocated parallel to the axes of the gear shafts 25 and 26 by a conventional actuator or drive (not illustrated) forming part of the surrounding packaging machine 1.

The numerals 42, 43 and 44 (see FIG. 2) respectively denote a substantially vertical linear actuator, mounted to a fixed part of the machine 1 between the moving blade 33 and the belt loop 29, a connecting rod attached to the moving part of the actuator 42, and a rocker attached to the connecting rod 43; the rocker 44 is freely supported by conventional means (not shown in the drawings), and made to pivot clockwise by the actuator 42, rotating about a horizontal axis that lies parallel to those of the gear shafts 25 and 26. The rocker 44 comprises retraction means including a tooth 45 which, on rotation of the rocker, is moved into the path followed by the strip 22 along the horizontal table 30.

Operation of the machine will now be described.

FIG. 2 depicts, in elevation and on a larger scale than used in FIG. 1, a portion of the cigarette packaging machine. The viewpoint of FIG. 2 is indicated by the line II—II in FIG. 1.

In FIG. 2, the continuous strip of paper 22 is shown entering from the left (from a bulk roll, not shown), passing between the pair of pinch rollers 20 on counter-rotating shafts 21 and between meshed gears 23, 24 on counter-rotating shafts (thereby becoming corrugated). The now-corrugated continuous strip of paper is fed on the gear 24 to a timing belt loop 29 entrained about first and second pulleys 27 and 28. The corrugations of the paper strip 22 are carried by the downwardly facing lower run of the timing belt loop 29 along the upwardly facing surface of the horizontal table, into a header block, i.e., the station depicted at the right in FIG. 2. At this station (which is shown on a larger scale in FIG. 3), the cutting means 34 is operated to successively cut discrete pieces 19 from the leading end of the corrugated strip of paper 22.

Arriving in regular succession at the work and transfer station 11, groups 7 of cigarettes enfolded in foil wrappers 8 are ejected one after the other from the pockets 6 of the first wheel 2 by the push rod 10, and positioned in the empty space between the platform 14 and plate 15 of the elevator, which will be occupying their upper limit positions (denoted by the bold line in FIG. 3).

As each foil-wrapped group 7 enters the station, the cutting means 34 separate a discrete piece 19 from the continuous strip 22 of paper. It will be recalled that the strip passes through the gears 23 and 24 of the corrugating means and is drawn along the table 30 by the bottom branch of the belt loop 29, functioning as a feed mechanism in combination with the right hand gear 24. Accordingly, the discrete piece 19 cut at each indexed step exhibits an evenly undulating profile. Once cut, the piece 19 of corrugated paper is pushed down toward the bottom of the chamber 37 by the vertical members of the shoe 40 and comes to rest with one of its corrugated edges alongside the push rod 41 (FIG. 3).

The moment that the group 7 is positioned in the elevator 14–15, the push rod 41 will stroke forward, transferring the distance piece 19 onto the group 7, whereupon the elevator 14-15 descends, carrying the group 7 and the corrugated distance piece 19 down into the waiting pocket 13 of the second wheel 3 (see the phantom line, in FIG. 3). As operation progresses, each indexed step of the wheel 3 will take a group 7 of foil-wrapped cigarettes and a relative corrugated distance piece 19 round toward the runout station 16 where they are transferred by conventional means to the third conveyor wheel 4.

In the event that transfer of the groups 7 of cigarettes to the second wheel 3 is interrupted for any reason, for example due to sub-standard groups being knocked out at one of the stations up-line of the first wheel 2, the supply of corrugated distance pieces 19 to the chamber 37 will be suspended. This is accomplished by braking or stopping the two pinch rollers 20, and stopping the gears 23 and 24 and the pulley 27 (via means that are neither described nor illustrated, being conventional). The actuator 42 will also operate so as to rotate the rocker 44 and bring its tooth 45 into contact with the stretch of corrugated paper strip 22 approaching the cutting means 34; the stretch of paper thus engaged is drawn back marginally from the blades 32 and 33 so as to ensure that their continued action, pending arrival of a further group 7 of cigarettes at the pockets 13 of the second wheel 3, will not cause thin slivers to continue separating from the end of the strip 22.

In an alternative embodiment of the invention, the belt loop 29 might be dispensed with, and the corrugated strip 22 propelled along the table 30 by a gear 46 (see the phantom line, in FIG. 3) mounted in the place of the relative pulley 27 and meshing with the gear 24 below in similar fashion.

Similarly, a glueing device (not illustrated) might be incorporated for the purpose of depositing dabs of adhesive between each foil-wrapped group 7 of cigarettes and the relative corrugated distance piece 19, with the end in view of ensuring better adhesion of the two items during subsequent steps of the manufacturing process.

What is claimed:

1. A cigarette packaging machine, comprising:

first conveyor means, by which single groups of cigarettes are supplied in succession to a work station, each group being a parallelopiped comprising at least one layer of cigarettes and having two opposite faces, two opposite sides and two opposite ends;

a feed device, designed to position a corrugated paper distance piece in contact with one face of a group of cigarettes occupying the work station;

second conveyor means, by which the single groups of cigarettes are carried away in succession from the work station together with their respective distance pieces;

infeed means, serving to advance a continuous strip of paper along a path toward the work station, the continuous strip of paper having a leading edge;

corrugating means serving to provide the continuous strip of paper with a uniformly undulated profile and thereby converting said continuous strip of paper into a continuous corrugated strip;

cutting means, by which the continuous corrugated strip is severed into discrete corrugated paper distance pieces;

means by which the distance pieces are transferred to the work station for positioning by said feed device.

2. A packaging machine as in claim 1, wherein:

said first and second conveyor means comprise intermittently driven wheels each having a plurality of regularly spaced peripheral pockets in which the single groups of cigarettes, in use, are accommodated; and said work station coincides with a point at which single groups of cigarettes are transferred from the first conveyor means to the second conveyor means.

3. A packaging machine as in claim 1, further including:

a table arranged to have the continuous strip of paper advance therealong toward said cutting means; and wherein the infeed means comprise a gear and a timing belt having a plurality of runs, said gear and said belt being engaged in meshing contact and arranged in such a way that one run of the belt rides substantially in contact with said table along which the continuous strip of paper advances.

4. A packaging machine as in claim 1, wherein:

the infeed means comprise two gears in meshing contact, and a table, said table extending between the two gears and the cutting means, and being arranged so that, in use, the continuous strip of paper advances along the table from the two gears towards the cutting means.

5. A packaging machine as in claim 1, wherein:

said cutting means comprises a fixed blade and a moving blade, wherein the fixed blade is afforded by one edge of a table along which the continuous strip of paper advances toward the cutting means.

6. A packaging machine as in claim 1, wherein:

the means by which the distance pieces are transferred to the work station comprise pushing means operating in a direction perpendicular to that in which the continuous strip of paper advances toward the cutting means.

7. A packaging machine as in claim 1, further including:

retraction means, located between the corrugating means and the cutting means, by which the leading edge of the continuous strip of corrugated paper can be drawn back from the work station through a given distance in the event that at least one group of cigarettes fails to arrive at the work station.

8. A packaging machine as in claim 7, wherein:

the retraction means comprise a tooth that can be placed in said path for engagement in a corrugation of the continuous strip of corrugated paper.

* * * * *